United States Patent [19]

Davini

[11] 4,228,957

[45] Oct. 21, 1980

[54] SPRAY GUN

[75] Inventor: Giorgio Davini, Milan, Italy

[73] Assignee: Basfer S.R.L., Milan, Italy

[21] Appl. No.: 895,087

[22] Filed: Apr. 10, 1978

[51] Int. Cl.[3] ..... B05B 1/28

[52] U.S. Cl. ..... 239/300; 239/311

[58] Field of Search ..... 239/300, 411, 410; 251/63.5, 63.6

[56] References Cited

U.S. PATENT DOCUMENTS

| | | | |
|---|---|---|---|
| 1,332,544 | 3/1920 | Davis | 239/411 |
| 1,401,397 | 12/1921 | Day | 239/300 |
| 2,708,095 | 5/1955 | Mitchell | 239/300 X |
| 3,622,078 | 11/1971 | Gronert | 239/411 |

FOREIGN PATENT DOCUMENTS

| | | | |
|---|---|---|---|
| 2259644 | 2/1974 | France | 239/411 |

*Primary Examiner*—Richard A. Schacher

*Attorney, Agent, or Firm*—Robert E. Burns; Emmanuel J. Lobato; Bruce L. Adams

[57] ABSTRACT

A gun, for spraying paint, of the type that comprises a nozzle for spraying the paint, a pair of oppositely located nozzles for sending jets of compressed air to the sides of a spray cone in order to flatten and fan it out. A control valve is connected to the line supplying the compressed air to the pair of nozzles.

2 Claims, 3 Drawing Figures

SPRAY GUN

BACKGROUND OF THE INVENTION

This invention relates to a gun for spraying paint of the type that comprises a nozzle for spraying the paint, a pair of oppositely located nozzles for sending jets of compressed air to the sides of the spray cone in order to flatten and fan it out, and a control valve connected to the line supplying the compressed air to the pair of nozzles.

DESCRIPTION OF THE PRIOR ART

With the spray guns currently in use, the changeover from cone spraying (particularly suitable for painting uneven surfaces in positions relatively far away from the operator) to fan spraying (particularly suitable for painting flat surfaces close to the operator) or vice versa, is made by manually rotating a screw type knob, thereby causing the displacement of the shutter of the valve connected to the line to the nozzles that send compressed air to the sides of the spray of paint. Regulation problems are encountered, however, with this known system since the adjustment takes time and has to be made carefully so as to stop the rotation of the knob once the desired effect has been achieved.

Thus when a frequent changeover is required from cone to fan spraying or vice versa, the operator has to make a considerable effort over a relatively long adjustment time, to the detriment of efficiency.

Furthermore, the regulation is additionally awkward on account of the fact that the operator generally works with gloves on and, therefore, has difficulty in rotating the knob.

SUMMARY OF THE INVENTION

The fundamental problem with the present invention is to make the procedure for changing over from cone to fan spraying or vice versa extremely quick and easy, and to dispense with the need to effect the regulation each time a changeover is made from one type of spraying to the other.

This problem is solved with the spray gun according to the invention comprising: a nozzle for spraying the paint; a pair of oppositely located nozzles for sending jets of compressed air to the sides of the spray cone in order to flatten and fan it out; and a control valve connected to the line carrying compressed air to the pair of nozzles. A essential feature of the gun is that the shutter of the valve is fixed to a movable rod that reciprocates from a closed position, corresponding to cone spraying, to an open position, corresponding to fan spraying. This latter position is determined by an adjustable limit device and operating means being provided to alternately displace the movable rod into one or the other of the positions.

The advantages this invention offers lie, in particular, in the fact that once an initial regulation has been made, no further adjustments are necessary and indeed to effect a changeover from fan spraying to cone spraying or vice versa, all that has to be done is to displace the movable rod into one or the other position.

BRIEF DESCRIPTION OF THE DRAWINGS

Two preferred but not sole forms of embodiment for the spray gun according to the invention will now be described as unlimited examples with reference to the accompanying drawings, in which.

DESCRIPTION OF THE PREFERRED EMBODIMENTS

Figure 3:
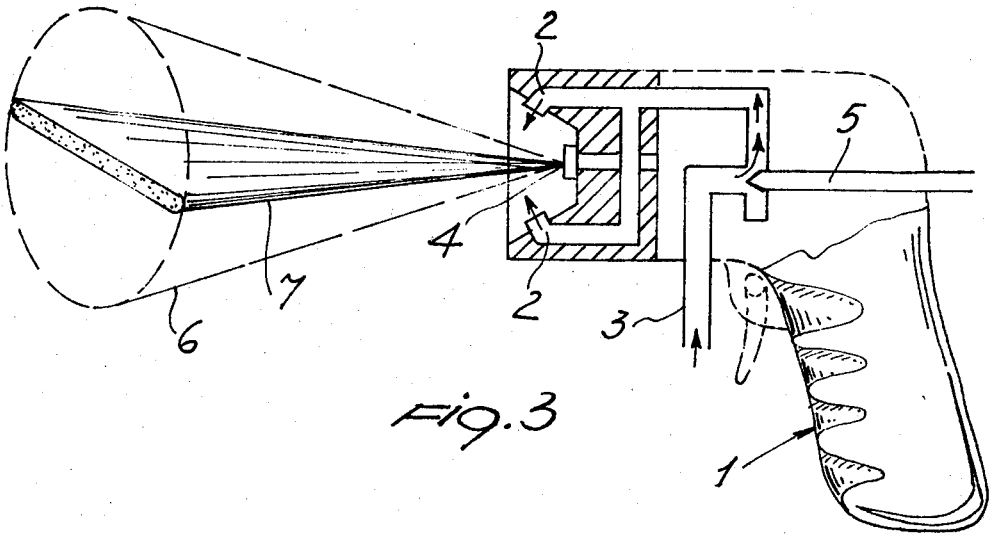
FIG. 3 shows, diagrammatically, the device for changing over from cone to fan spraying.

As illustrated in FIG. 3, a spray gun is normally equipped with a device to allow a changeover to be made from cone to fan spraying or vice versa. The device comprises a pair of nozzles 2 connected to a compressed air supply line 3 and positioned one on each side of the nozzle 4 used to spray the paint. A valve with a conical shutter carried by a movable rod 5 is connected to the said supply line 3.

When the valve is closed, the spray is cone shaped, as shown with broken lines at 6 in FIG. 3, while when the valve is open, the spray takes the form of a fan, as shown at 7 in FIG. 3, following the sending of compressed air through the nozzles 2.

Figure 1:
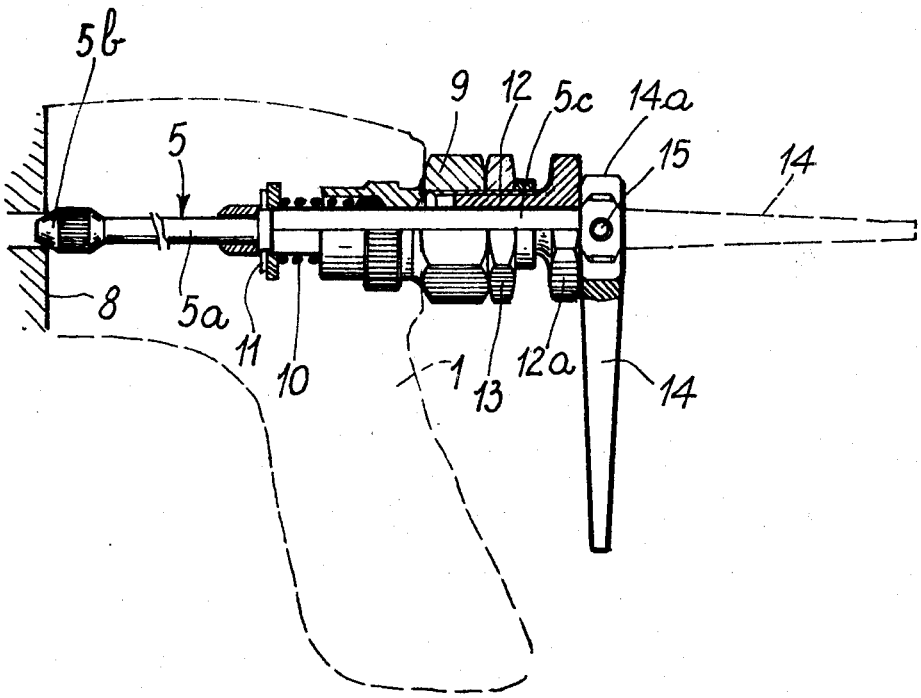
FIG. 1 is a sectional view, of part of a spray gun, of a first form of embodiment of the invention.

In a first form of embodiment, shown in FIG. 1, the movable rod, shown globally at 5, is composed of a thin portion **5*a*, carrying a tapered tip 5*b* that cooperates with the valve seat 8, and by a part of a longer section 5*c* mounted slidingly inside a tubular body 9. The latter is fixed, screwed for example, to the rear part of the gun 1** and partially projects out of this.

The part **5*c* of the rod 5 carries a spring 10 having one extremity connected to the tubular body 9, and the other locked by a pin 11 fixed transversely to the part 5*c*. The spring 10 tends to keep the tapered tip 5*b* seated on the valve seat 8**, in the closed position.

The part **5*c* also extends slidingly inside a sleeve 12 screwed to a widened terminal portion of the tubular body 9. Furthermore, the sleeve 12 is provided with a flange nut 12*a*, and by turning this it is possible to screw the sleeve 12 more or less into the tubular body 9**.

To lock the sleeve 12, a lock nut 13 is provided threaded on the sleeve and in the locking position, this engages with the tubular body 9.

The flange **12*a* of the sleeve 12 acts as a terminal plate for a lever 14 pivoted to the external extremity of the part 5*c* of the rod 5, through a pin 15. The lever 14 can be placed in the position shown in FIG. 1 with its axis at a right angle to that of the rod 5, or in a position rotated through 90°, with its axis coincident with that of the rod 5, as shown in broken lines in the same figure. In the first position, the lever 14 engages with the flange 12*a* on one side, while in the other position the lever engages with the flange through a portion 14*a*, the end surface of which is perpendicular to the axis of the lever. The mentioned end surface is situated a distance away from the pin 15 that is greater than the distance the pin is away from the aforementioned terminal plate, when the lever 14 is in the position illustrated with continuous lines in FIG. 1. In this way, when changing from the latter position to that shown in broken lines in FIG. 1, the rod 5 is displaced to the right (with reference to FIG. 1), the actual displacement depending on the position of the flange 12*a* with respect to the tubular body 9, and the valve is opened as a result of the tapered tip 5*b* moving away from the valve seat 8, while the spring 10** is compressed.

In this condition, with the lever 14 positioned as shown in broken lines in FIG. 1, the valve of the compressed air supply line 3 is open and thus air is sent, via the nozzles 2, onto the jet of paint, in such a way as to transform the cone spray 6 into a fan spray 7 (FIG. 3).

To regulate the opening of the valve, or in other words, in order to get the spray of paint into an exact fan shape, action can be taken at the time the setting is made, once the nut 13 has been loosened, to screw the sleeve 12 further or less deeply into the tubular body 9, so as to displace the terminal plate for the lever 14, the former constituted by the flange 12*a*, with respect to the tubular body 9. When the sleeve 12 is screwed into the tubular body 9, the flange 12*a* approaches the body 9, thereby reducing the valve opening when the lever 14 is positioned on an axis coincident with that of the rod 5, as shown in broken lines in FIG. 1.

This setting operation corresponds to a pre-regulation that has to be made from time to time. Subsequently, the spray gun can be used, without further adjustments, with the lever 14 just being displaced into one position or the other in order to obtain either a cone shaped spray or a fan shaped spray.

As can be seen, the changeover from one type of spray to the other can be effected very easily and very rapidly by merely displacing the lever 14, without there being any need to check or regulate the conformation of the spray and this, as stated earlier on, is because the regulation is made at the time of the setting operation.

The return displacement of the rod 5 through which the obturation of the valve seat 8 takes place on the part of the tapered tip 5*b*, is brought about under the action of the spring 10, when the lever 14 is displaced from the position shown in broken lines in FIG. 1 to that shown on the same drawing with continuous lines.

Figure 2:
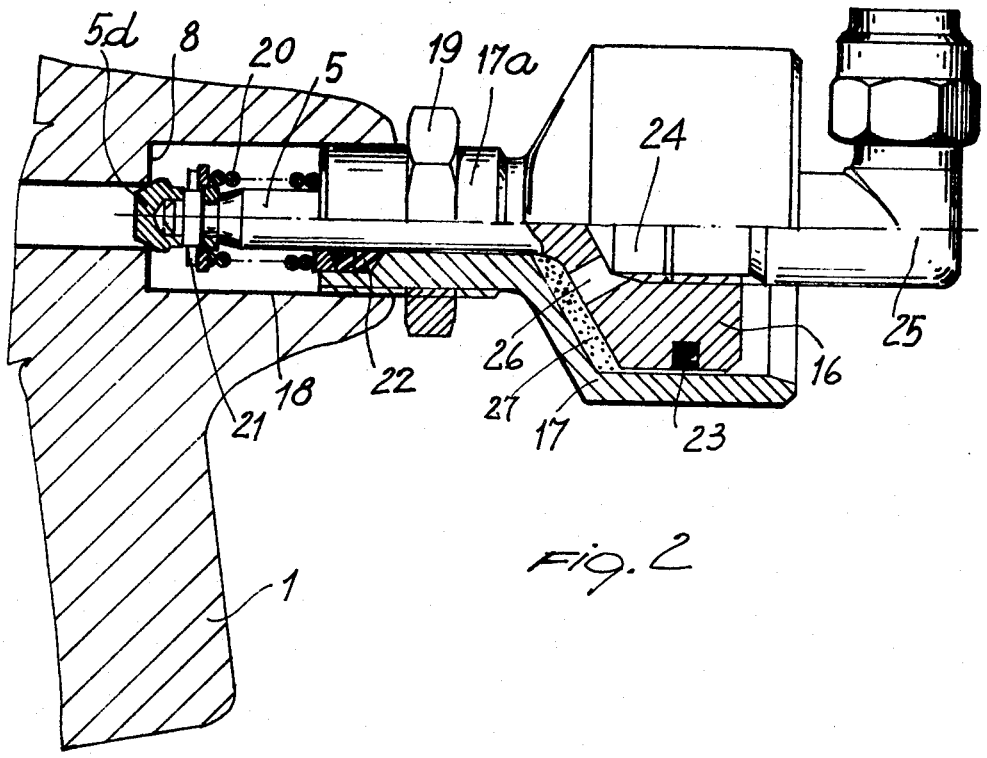
FIG. 2 is a sectional view, of part of a spray gun, of a second form of embodiment of the invention.

For spray guns that are intended to operate on automatic machines, a special form of embodiment, as shown in FIG. 2 is envisaged.

In the second form of embodiment the parts corresponding to those of FIG. 1 have similar reference numerals. The movable rod 5 that carries a truncated cone shaped tip 5*d* cooperating with the valve seat 8, constitutes the stem of a piston 16 that belongs to a pneumatic cylinder, the cylindrical jacket 17 of which is integral with the rear part of the gun 1. To be more precise, the cylindrical jacket 17 is of a cup shaped configuration and it has a narrower, tubular structure, extension piece 17*a* which can be screwed into a threaded hole 18 provided for this purpose in the body of the gun 1. The locking of the cylindrical jacket 17 is achieved by tightening a nut 19 which is threaded onto the section 17*a*, until it comes into contact with the body of the gun 1.

The rod 5 passes slidingly inside the section 17*a* and is inserted into a spring 20, one extremity of which engages with the section 17*a* and the other with a pin 21 fixed transversely to the rod 5.

A seal 22 is inserted between the rod 5 and the section 17*a*, while another seal is inserted between the piston 16 and the cylindrical jacket 17, the second seal being 23.

The piston 16 is provided axially with a threaded cavity or recess 24 into which is screwed a connection 25 for the supply of compressed air. The recess or cavity 24 communicates, via a passage 26 machined into the piston 16, with a chamber 27 formed between the cylindrical jacket and the piston 16. By sending compressed air to the chamber 27, through the passage 26, the cavity 24 and the connection 25, the piston 16 is made to displace to the right, with reference to FIG. 2, with the consequent opening of the valve because of the tip 5*d* moving away from the valve seat 8, while the spring 20 is compressed. The limit for the displacement is determined by the complete compression of the spring 20.

Subsequently, by placing the chamber 27 in communication with the air outlet, the spring 20 causes the rod 5 to return to its starting position, with the tip 5*d* in contact with the valve seat 8, in the closed condition.

To regulate the valve opening position, the cylindrical jacket 17 has to be axially displaced and the relevant extension piece 17*a* screwed further in or less deeply in, once the lock nut 19 has been slackened off. This causes the terminal surface offered by the extension piece 17*a* to the spring 20 to be displaced in such a way as to vary the opening travel of the rod 5. Following the realization of the desired regulation, the cylindrical jacket 17 is locked to the body of the gun 1 and this is done by tightening the nut 19 until it comes up against the said body.

With the form of embodiment depicted in FIG. 2, automatic remote control is possible with compressed air being sent into the chamber 27 via the connection 25.

Similarly to the first form of embodiment described above, after the initial regulation, the operator, or the automatic control device, takes action to displace the rod 5, or in other words, the tip 5*d*, into one or the other of the two possible positions, that is to say, the closed position and the open position, respectively.

The present invention is naturally not limited to the above described forms of embodiment but can be realized in other modified forms without in any way deviating from the framework of protection afforded thereto.

What is claimed is:

1. A spray gun comprising: a body having a threaded hole, a nozzle in said body for spraying paint and the like; a pair of oppositely located nozzles for sending jets of compressed air to the sides of a spray cone in order to flatten and fan it out; a control valve for controlling supply of compressed air to the said pair of nozzles, a valve element in said control valve, a movable rod fixed to the valve element that reciprocates from a position closing the control valve and corresponding to cone spraying, to an open position, corresponding to fan spraying, an adjustable limit device determining the open position; pneumatic means, of the single acting type, to alternately displace said movable rod into one or the other of the said positions, said pneumatic means comprising a cylindrical jacket of a cup-shaped configuration having a narrower, tubular structure, extension piece adjustably screwed into said threaded hole provided in the body of the gun, a piston provided with an axial hole communicating with a connection for the supply of compressed air, said jacket and said piston defining a chamber therebetween, said hole in said piston communicating moveover, via a passage machined into the same piston, with said chamber formed between said cylindrical jacket and said piston; and said piston being a differential area type piston having a larger area on a downstream face thereof.

2. A spray gun according to claim 1, comprising a nut threaded onto said extension piece to lock said cylindrical jacket relatively to said body of the gun.

* * * * *